United States Patent [19]

Davenport et al.

[11] 4,396,304

[45] Aug. 2, 1983

[54] PRINT HEAD AND DRIVE CIRCUIT

[75] Inventors: Keith B. Davenport, Sandhurst; Roman Derc, Tarporley, both of England

[73] Assignee: International Computers Limited, Stevenage, England

[21] Appl. No.: 324,433

[22] Filed: Nov. 24, 1981

[51] Int. Cl.[3] ..... B41J 3/10

[52] U.S. Cl. ..... 400/124; 101/93.05; 400/157.2

[58] Field of Search ..... 400/124, 157.2, 166; 101/93.02, 93.03, 93.05; 361/155, 156

[56] References Cited

U.S. PATENT DOCUMENTS

| | | | |
|---|---|---|---|
| 3,158,791 | 11/1964 | Deneen et al. | 361/155 |
| 3,374,402 | 3/1968 | Derc | 361/156 X |
| 3,405,327 | 10/1968 | Cole et al. | 361/153 |
| 3,507,213 | 4/1970 | Derc | 361/156 X |
| 3,889,793 | 6/1975 | Cattaneo | 400/124 |
| 3,900,095 | 8/1975 | Tanabe | 361/156 X |

*Primary Examiner*—Paul T. Sewell

*Attorney, Agent, or Firm*—Lee, Smith & Jager

[57] ABSTRACT

Wire printing apparatus includes a print head having at least one print wire and associated actuating mechanism and drive circuit. In the drive circuit a capacitor is charged to a predetermined voltage through an inductance and then discharged through the coil of an electromagnet in the actuating mechanism. The current through the coil is arranged to rise and then fall. The circuit permits optimization to maximize the proportion of the energy input to the drive circuit which is transferred to the print wire.

3 Claims, 7 Drawing Figures

PRINT HEAD AND DRIVE CIRCUIT

BACKGROUND

This invention relates to wire printing apparatus. Such apparatus prints by projecting a printing wire towards a record medium and making an impression in the form of a dot on the record medium. Usually the dots are arranged as characters of the well-known dot-matrix type.

In the usual arrangement the wire is projected towards the record medium by an actuating mechanism consisting essentially of an electromagnet and an armature. The armature is normally held in an open position with the back end of the printing wire biassed against it. When it is desired to cause the print wire to make a dot, current is passed through the coil of the electromagnet and the armature is attracted towards the electromagnet, carrying the print wire with it. The armature is brought to a stop against the electromagnet but the print wire continues, projected towards the record medium with the kinetic energy already imparted to it.

The source of the current passed through the coil of the electromagnet is a drive circuit. Hitherto, drive circuits have used predetermined voltage drive circuits and predetermined current drive circuits. In a voltage drive circuit the coil is switched between two voltage rails for a predetermined time. During this period the current rises at a rate determined by the voltage and the inductance and resistance of the coil. In a current drive circuit the arrangement is similar, but the peak current is limited to a predetermined value.

These circuits are relatively inefficient, defining efficiency for this purpose as the percentage of the energy supplied to the drive circuit that is passed on to the print wire. The more inefficient the drive circuit, the larger is the power supply that is necessary and the greater is the heat dissipation within the head assembly. This last factor is especially disadvantageous as limiting the repetition rate at which drive signals can be applied to the head.

SUMMARY OF THE INVENTION

According to this invention the drive circuit has a capacitor which is charged to a predetermined voltage by a charging path containing an inductor and switching means arranged to interrupt charging of the capacitor when that voltage is reached. The actuator coil is situated in a discharge path from the capacitor which is closed for a predetermined period to actuate the print wire. During this period the current in the discharge path increases to a maximum and starts to fall away. The circuit provides a controlled amount of energy to actuate the print wire, and a relatively uniform force on the armature, both of which increase the efficiency of the circuit.

BRIEF DESCRIPTION OF THE DRAWINGS

An example of wire printing apparatus in accordance with the invention will now be described in greater detail with reference to the drawings, in which.

DESCRIPTION OF THE PREFERRED EMBODIMENT

Figure 1:
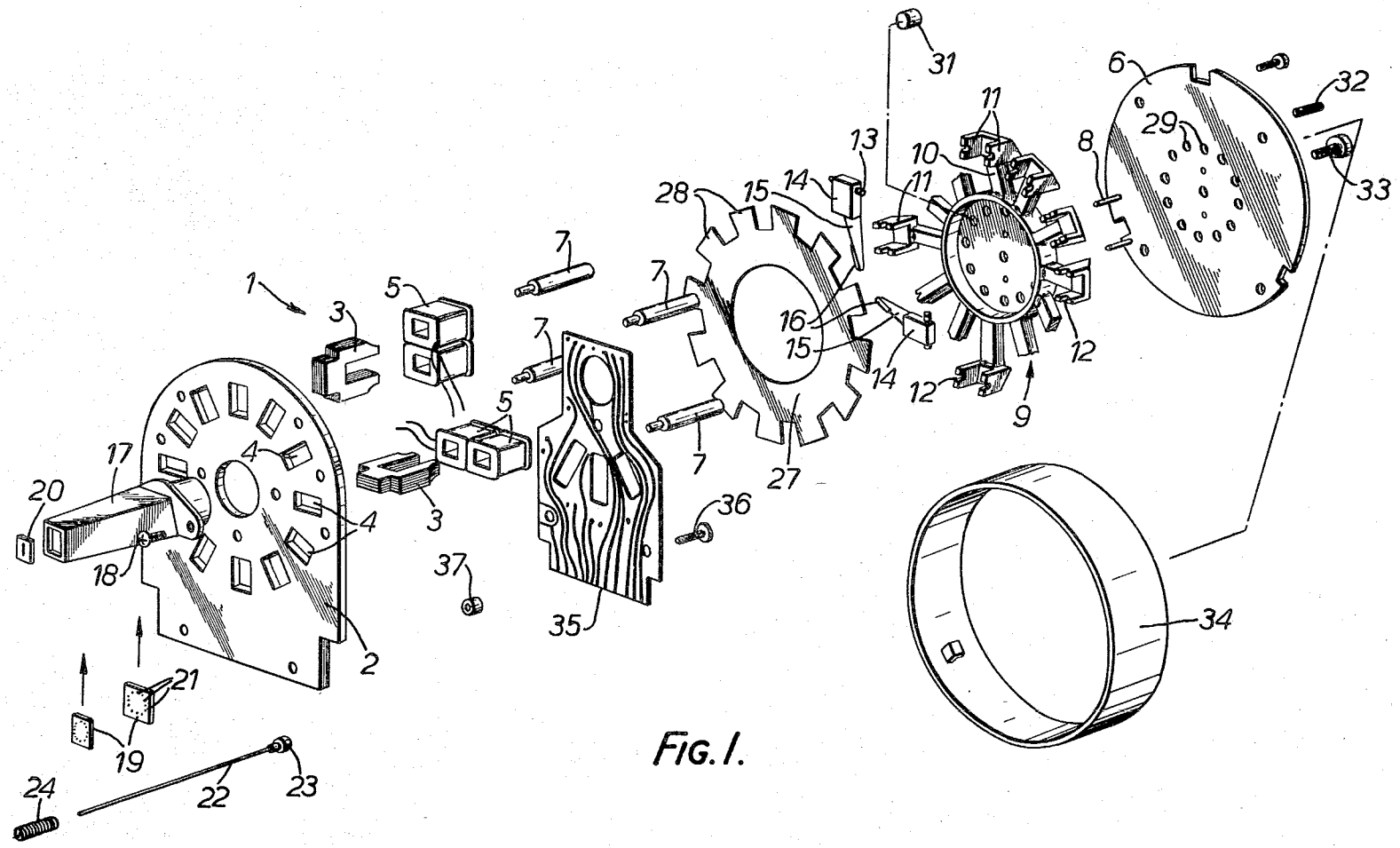
FIG. 1 is an exploded view of the print head of the apparatus.
Figure 2:
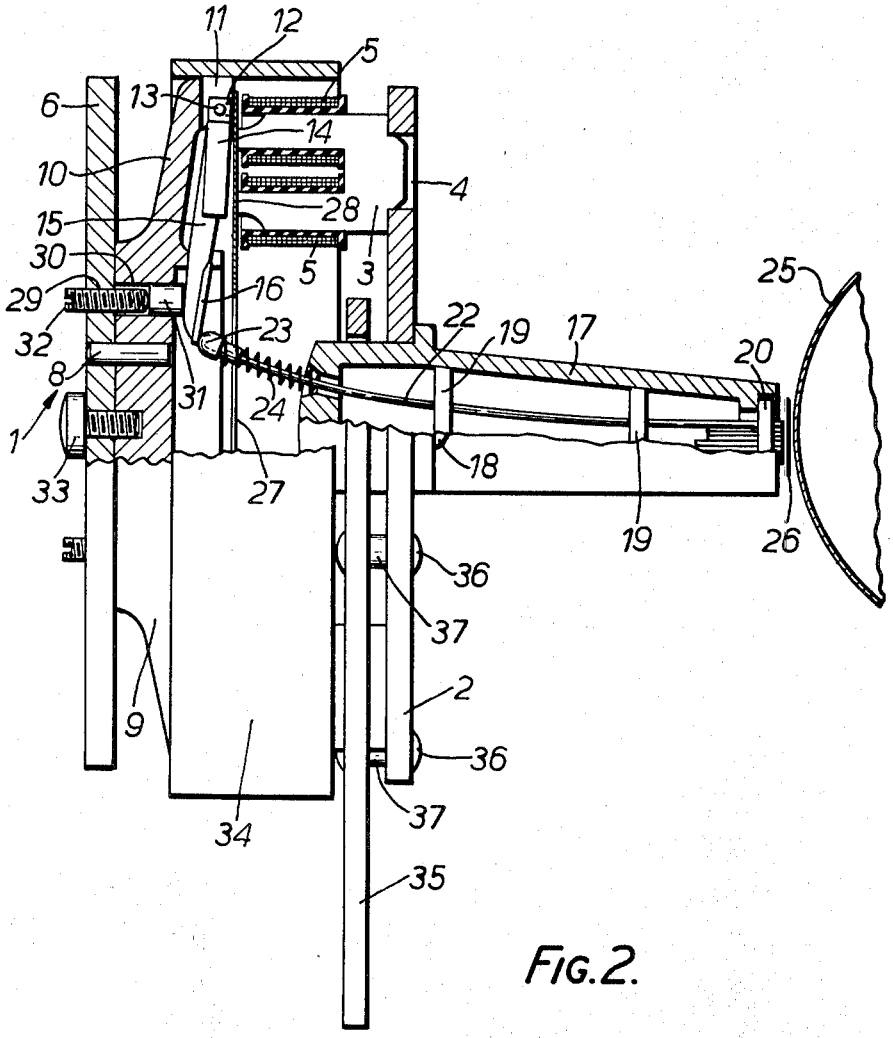
FIG. 2 is a section through the print head.

Referring now to FIGS. 1 and 2 of the drawings, the wire printing apparatus has a print head 1 carried on a main mounting plate 2. The plate 2 carries a number of U-shaped electromagnet yoke assemblies 3, each built up from a number of laminations, the bases of the U-shapes being held in apertures 4 in the plate 2. A coil assembly 5 is positioned on each limb of the yoke assemblies 3. An end plate 6 is spaced away from the main plate 2 by spacers 7 and the plate 6 carries, by means of dowel pins 8, an armature support frame 9. A fixing screw 33 secures the frame 9 to the plate 6. The frame 9 has a number of peripheral fingers 10, one for each yoke 3 and the fingers 10 each have a pair of recessed lugs 11, turned inwardly to face the yokes 3. The recesses 12 in the lugs 11 accommodate projecting pivots 13 of armatures 14, the arrangement of the frame 9 being such that each armature 14 is pivoted adjacent a corresponding one of the yokes 3. Each armature 14 has a projection 15 carrying an ear 16.

A nose piece 17 is secured to the main plate 2 and projects outwardly on the opposite side of the plate 2 from the yokes 3, being secured to the plate 2 by screws 18. The nose piece carries a pair of intermediate wire guides 19 and a terminal wire guide 20. The guides 19 and 20 have a number of guide holes 21 for printing wires 22, the terminal guide 20 having its guide holes in any configuration, for example of holes in a vertical line, and the intermediate guides 19 have wire guide holes arranged in a suitable configuration to permit the wires 22 to be aligned at one end each with the ear 16 of a corresponding one of the armatures 14, the other ends of the wires 22 projecting from the terminal guide 20.

That end of each wire 22 adjacent the ear 16 of the corresponding armature 14 is fitted with a ferrule 23 which bears against the ear 16 under the influence of a return spring 24, so that the effect of energising the electromagnet coils 5 is to attract the appropriate armature towards the electromagnet from a normal open position to a closed position, driving its associated printing wire 22 with it. When the armature is brought to a halt in the closed position, the print wire continues with the kinetic energy already imparted to it towards a printing position at which it strikes a conventional record member 25 (as best seen in FIG. 2) through a transfer medium such as a printing ribbon 26, to make a mark on the record. Once the coils 5 are de-energised, the return spring 24 restores the wire 22 into its retracted position.

A non-magnetic member 27 is provided, having a projecting ear 28 corresponding to each coil position within the head, each ear 28 being interposed between the ends of the yoke assemblies 3 and the associated armature 14 to provide a conventional residual non-magnetic gap spacer against which the armature bears in the closed position. The end plate 6 is provided with a ring of threaded holes 29 each aligned with a corresponding hole 30 in the armature support frame 9. A resilient plug 31, carried in each of the holes 30, forms a backstop damper for each of the armatures. Screws 32 in the holes 29 of the end plate 6 are provided for the adjustment of the position of the dampers 31, and consequently the air gap separating the open and closed positions. The rear of the head assembly is protected by a cover 34. Connections of the coils 5 are conveniently arranged by the use of a printed wiring board 35 which is secured to the main plate 2 by rivets 36 and spacers 37, the board 35 being formed at one edge with connection fingers to receive a suitable socket (not shown).

Figure 3:
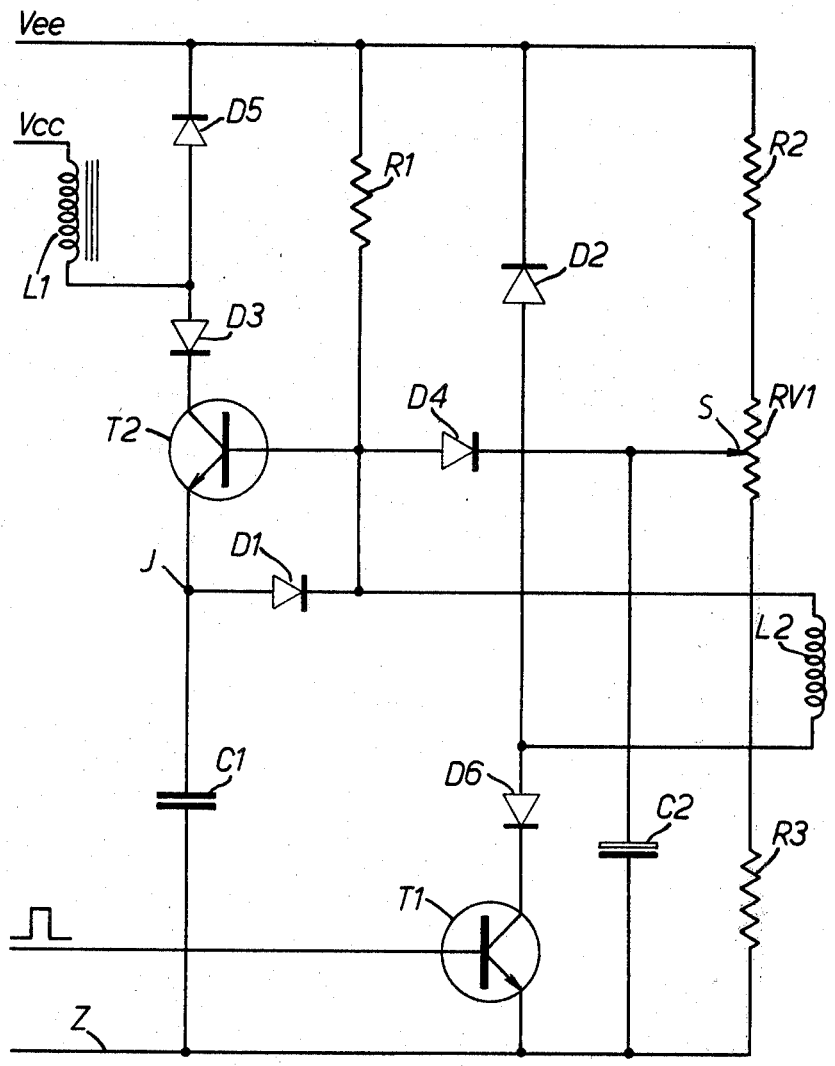
FIG. 3 is a circuit diagram of the drive circuit.

Referring to FIG. 3, the drive circuit provides a capacitor C1 which is charged through a charging path consisting of a transistor switch T2, diode D3 and an inductor L1 from an unregulated power supply connected between a zero line Z and a Vcc line. A discharge path for the capacitor C1 through a load L2, is provided by diodes D1, diode D6 and transistor switch T1. The load L2 represents the coils 5 of one of the print wire actuators of FIGS. 1 and 2. Other parts of the circuit will be described in the following description of the operation of the circuit.

Assuming that the capacitor C1 is already charged, the actuator coil L2 is energised by applying a positive pulse to the base of transistor switch T1. This pulse turns T1 on so that current flows from capacitor C1 via diode D1 through the actuator coil L2 and thence through diode D6 and transistor T1 to the zero line Z. During this discharge, transistor T2 is held non-conductive by the voltage drop across diode D1. Termination of the positive pulse on the base of transistor T1 turns T1 off to a non-conductive condition. When transistor T1 is turned off, current will continue to flow through the actuator coil L2 and is returned to a line Vee connected to a regulated voltage power supply having a higher potential than Vcc. This current flow continues to hold transistor T2 in a non-conductive condition due to the voltage drop developed across diode D1.

The base of transistor T2 is connected to the line Vee through a resistor R1 so that when the current through the actuator coil L2, and hence through the diode D1, falls to zero transistor T2 is turned on and becomes conductive to permit the capacitor to be charged through the charging path consisting of inductor L1, diode D3 and transistor T2 from the power line Vcc.

A potential divider consisting of potentiometer RV1 and resistors R2 and R3 is connected between Vee and the zero line Z to provide on slider S a preset variable potential. A by-pass capacitor C2 is connected between the slider S and the zero line Z. As the capacitor C1 is charged, the potential C1 at the junction J rises to a value relative to the present potential on the slider S such that the emitter/base junction of transistor T2 is biassed to divert the base current of transistor T2 through diode D4 to the slider S. The transistor T2 is thereby turned off and charging of C1 ceases. Diodes D3 and D6 are connected to the collector connections to transistors T2 and T1 respectively to prevent reverse bias on the collector/base junctions of these transistors.

While the capacitor C1 is being charged the current in the charging path behaves in a manner determined by the characteristics of the series LC circuit containing L1 and C1. The current increases against the inductance of L1 until the voltage across C1 is approximately Vcc. The current then continues to flow, but at a decreasing rate, until the voltage across C1 reaches the level at which T2 is caused to switch off. The magnetic energy still remaining in the inductor L1 at that point is then returned to the power supply Vee by a current flowing through D5.

The time taken to charge the capacitor C1 is determined by the parameters of the charging circuit, principally the inductance of L1, the capacitance of C1 and the ratio of the switch-off voltage across C1 to the voltage Vcc. It can be selected to be less than the time taken for a print wire to retract from the printing position to its rest position, so that it does not cause any delay if it is desired to operate the print wire again as soon as possible after its previous operation.

The energy stored in the capacitor C1 is accurately controlled by the setting of the slider S, which governs the voltage across the capacitor when T2 is turned off.

The time during which the capacitor C1 discharges through the actuator coil L2 is also accurately controlled and is equal to the width t of the actuating pulse applied to the base of the transistor T1 to turn it on. It is arranged to be substantially equal to the time taken for the armature to complete its movement and close the air gap.

Figure 4:
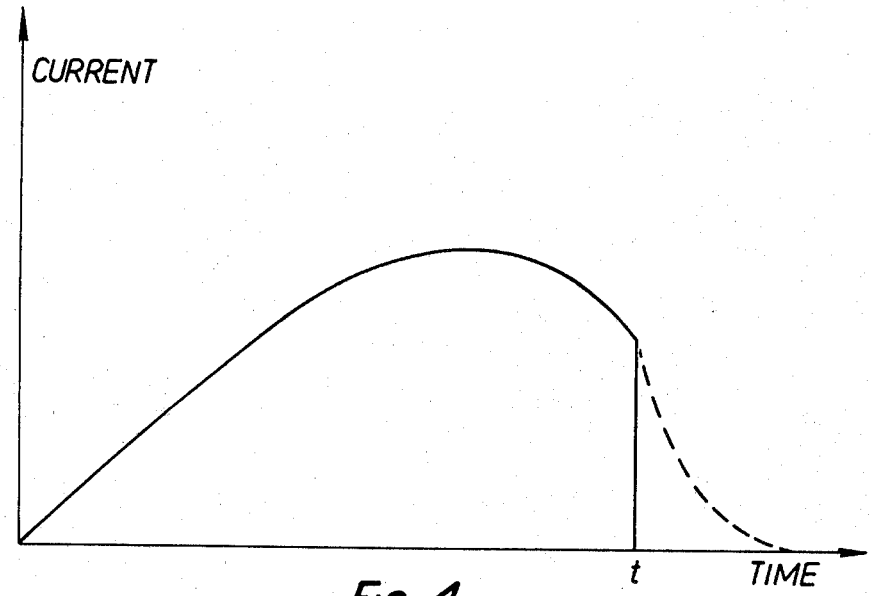
FIG. 4 is a graph of the current flow through the actuator coil.

The behaviour of the current in the discharge path is as shown in FIG. 4. It is determined by the characteristics of the series LC circuit containing L2 and C1. It rises to a maximum against the inductance of L2 and then falls as the capacitor C1 discharges further. After the transistor T2 has turned off at time t the energy remaining in the actuator coils L2 is returned to the power supply Vee by a current through D2, shown dotted in FIG. 4.

This behaviour, by which the current falls during the latter part of the actuating pulse, is an important distinction from the prior predetermined voltage and current drive circuits. In the first of those circuits the current increases continuously and in the second it increases to a limit and thereafter remains constant. Now the force exerted on the armature, for constant current, increases as the gap closes. We find that an arrangement in which the current falls during the latter part of the armature movement tends to counteract this increase in attractive force and leads to a more uniform force. That increased uniformity, we find, leads to greater efficiency by reducing stray fields and losses and increasing the proportion of the energy input to the drive circuit that is transferred to the print wire.

The fact that the energy stored in the capacitor is precisely controlled is an essential feature of the invention and ensures that the energy imparted to the print wire is precisely known and therefore that the energy input can be made no greater than required.

Additional factors of the apparatus described with reference to the drawings that assist in improving efficiency are the fact that T1 is switched off at substantially the instant the gap closes (switch-off later leads to unecessary losses as current flows through the coil after the gap has closed, whereas too early a switch-off leads to the need for greater forces than would otherwise be necessary) and the return of surplus energy in the inductor L1 and coil L2 to the Vee line.

Figure 5:
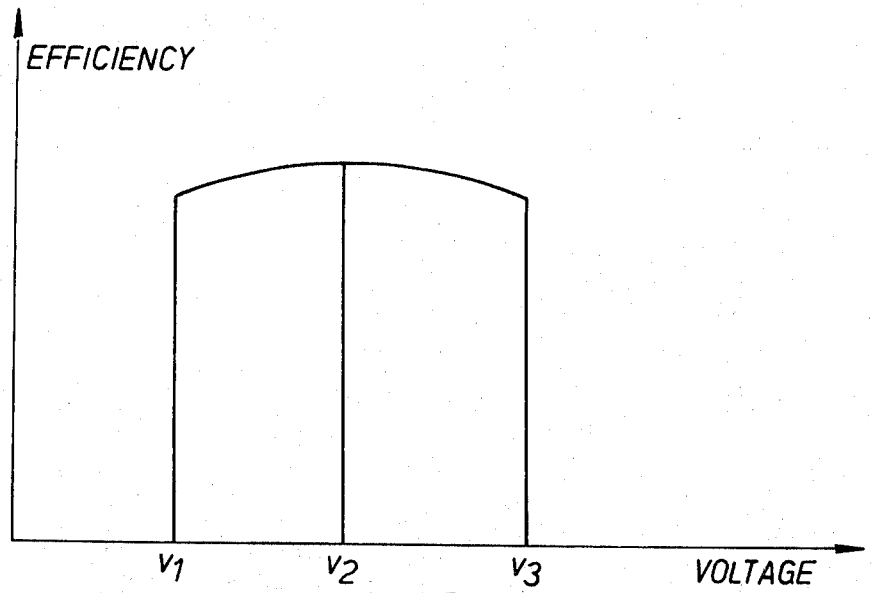
FIG. 5 is a graph showing the effect on efficiency of variation in the voltage across the capacitor.

Referring to FIG. 5, the predetermined value of the voltage to which the capacitor C1 is charged is chosen to be such as to maximise the efficiency of the circuit, that is the proportion of the energy accepted by the circuit that is transferred to the print wire. By "energy accepted" is meant the total energy input into the drive circuit less the energy returned via the diodes D2 and D5. Thus if the voltage across the capacitor is arranged to be $V_2$, the efficiency will be a maximum. However, as the change in efficiency for variations in voltage near $V_2$ is small, substantially as good an efficiency can be obtained if the voltage varies somewhat, for example to $V_1$ or $V_3$. This is useful because the energy imparted to the print wire varies in an approximately linear manner with respect to the voltage and by varying the voltage near $V_2$, by adjusting the slider S, the density of the print impression may be altered without significantly affecting the efficiency.

As an example, in one specific embodiment of the apparatus being described, the value of $V_2$ is 70 volts and the corresponding efficiency is 11%. At $V_1=65$ V and $V_3=75$ V the efficiency has fallen to 9.9%.

The armature air-gap may also be adjusted, by varying the setting of the backstop 31. It is found that there is one particular setting which minimises the time taken for the armature to close. This setting takes account of component tolerances, and by setting the air-gaps of all the armatures to give the minimum gap-closure time it can be ensured that the tips of all print wires, that are fired simultaneously, arrive at the print surface at very closely the same time, giving good dot alignment.

The optimisation of the efficiency of the apparatus is preferably carried out more widely than simply with respect to the capacitor charging voltage and air-gap setting. Starting from a desired print-wire mass and launch energy, time of gap closure and overall dimensions of the actuator, the other characteristics such as the dimensions of the yoke of the electromagnet, the number of turns of the electromagnet coils and the diameter of the wire used, together with the armature dimensions, may be selected as a set to optimise the efficiency. With such an optimised set alteration of any one component will reduce the efficiency, even if another component is altered to ensure that the initial requirements are still met.

The optimum setting may be discovered by systematic experiment, but is desirably carried out by calculation bearing in mind the mechanical and electromagnetic properties of the system and will yield the charging voltage of C1 and the air-gap setting. The latter may then be adjusted as described to account for tolerances. The fact that the calculation is possible is a consequence of the controlled nature of the energy input to the system and discharge from it.

The capacitance of C1 may be chosen arbitrarily, within reasonably wide limits, and will then determine L1 from the need for C1 to be charged in the required time. It will be one of the initial constraints on the optimisation of the other components.

Whilst the power supply connected to the line Vee generally needs to be voltage stabilised in order to define the input energy to the actuator coil with the required precision, the current drawn from this power supply is relatively low. Conversely the power supply connected to the line Vcc is required to deliver high current to provide energy for the actuator coil but generally does not need to be voltage stabilised.

Figure 6:
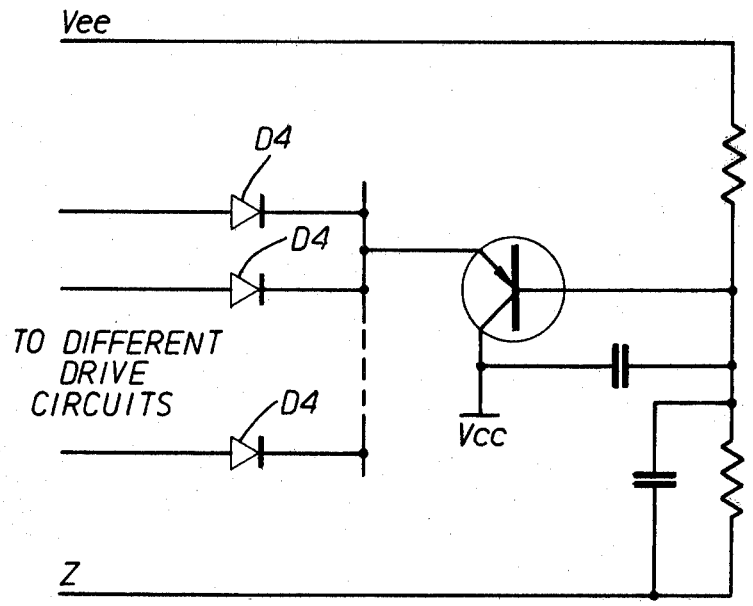
FIGS. 6 and 7 are circuit diagrams of modifications of the circuit of FIG. 3.

Two possible modicications will now be described. Fixed print intensity may be provided by replacing the potential divider arrangement R2, RV1, R3 of FIG. 3 with the circuit of FIG. 6, which may be used to control the capacitor voltage of all the drive circuits.

Figure 7:
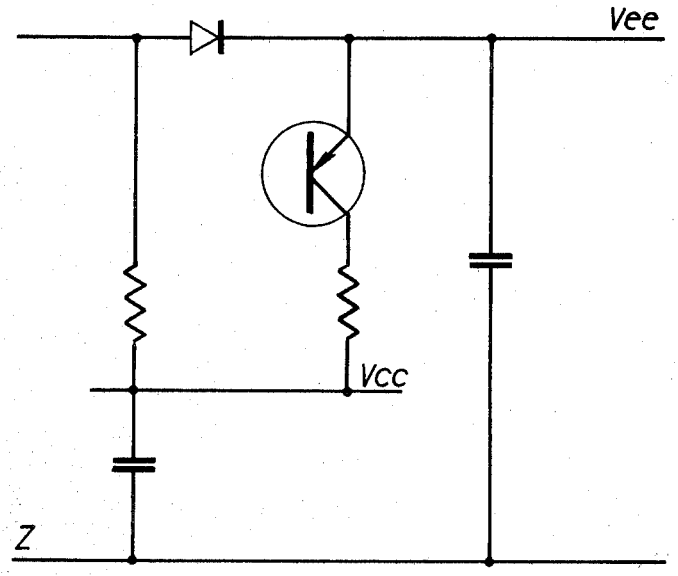

The circuit of FIG. 7 allows the current returned to Vee to be switched to Vcc if it exceeds the current being drawn from Vcc during charging of C1.

We claim:

1. Wire printing apparatus comprising:

a print head including a plurality of print wires and a plurality of electromagnetic actuators, one for each printing wire repectively; each actuator comprising a magnetic core, at least one coil electromagnetically coupled to the core and an armature mounted for movement relative to the core between an unoperated position and an operated position, the armature being operative during movement from the unoperated to the operated position to engage the corresponding print wire and thereby propel the print wire towards its printing position; a plurality of drive circuits, one for each electromagnetic actuator respectively, each comprising a capacitor; a charging path for the capacitor including an inductor and a first semiconductor switch; a discharge path for the capacitor including said coil of the actuator and a second semiconductor switch, said second semiconductor switch being operative during a switching period defined by the duration of a control pulse to cause the capacitor to discharge and produce an electric current through the coil effective to move the armature from its unoperated position to its operated position, first means responsive to the electric current to maintain the first switch non-conductive and second means operative to render the first switch non-conductive in response to the capacitor charging to a predetermined voltage; and the capacitor and coil having values of capacitance and inductance respectively such that the current rises to a peak value and then decreases during said switching period.

2. Apparatus as claimed in claim 1 including a unidirectional connection between the inductor and a line carrying power to the drive circuit effective to permit current to flow from the inductor to said power line when the first switch is rendered non-conductive and thereby utilise energy stored in the inductor to provide power for the drive circuit.

3. Apparatus as claimed in claim 1 including a unidirectional connection between the coil of the actuator and a line carrying power to the drive circuit effective to permit current to flow from the coil to said power line following the switching period and thereby utilise energy stored in the coil to provide power for the drive circuit.

* * * * *